US005355956A

United States Patent [19]

Restarick

[11] Patent Number: 5,355,956

[45] Date of Patent: Oct. 18, 1994

[54] PLUGGED BASE PIPE FOR SAND CONTROL

[75] Inventor: Henry L. Restarick, Houston, Tex.

[73] Assignee: Halliburton Company, Houston, Tex.

[21] Appl. No.: 952,561

[22] Filed: Sep. 28, 1992

[51] Int. Cl.[5] ..... E21B 43/10

[52] U.S. Cl. ..... 166/296; 166/51; 166/229

[58] Field of Search ..... 166/278, 276, 296, 228, 166/91, 294, 51, 115

[56] References Cited

U.S. PATENT DOCUMENTS

| | | | |
|---|---|---|---|
| 3,216,497 | 11/1965 | Howard et al. | 166/296 X |
| 3,268,001 | 8/1966 | Brandt | 166/296 X |
| 3,273,641 | 9/1966 | Bourne | 166/296 X |
| 3,333,635 | 8/1967 | Crawford | 166/296 X |
| 3,434,537 | 3/1969 | Zandmer | 166/296 X |
| 3,602,307 | 8/1971 | Price et al. | 166/278 |
| 3,726,343 | 4/1973 | Davis, Jr. | 166/278 |
| 3,880,233 | 4/1975 | Muecke et al. | 166/205 |
| 3,913,675 | 10/1975 | Smyrl | 166/278 |
| 4,018,282 | 4/1977 | Graham et al. | 166/278 |
| 4,202,411 | 5/1980 | Sharp et al. | 166/296 X |
| 4,498,543 | 2/1985 | Pye et al. | 166/376 |
| 4,635,725 | 1/1987 | Burroughs | 166/278 |
| 4,856,590 | 8/1989 | Caillier | 166/278 |
| 4,860,831 | 8/1989 | Caillier | 166/384 |
| 4,932,474 | 6/1990 | Schroeder, Jr. et al. | 166/296 X |
| 5,004,049 | 4/1991 | Arterbury | 166/228 |
| 5,062,484 | 11/1991 | Schroeder, Jr. et al. | 166/278 |
| 5,088,554 | 2/1992 | Arterbury et al. | 166/228 |
| 5,165,476 | 11/1992 | Jones | 166/278 |
| 5,190,102 | 3/1993 | Arterbury et al. | 166/228 |

FOREIGN PATENT DOCUMENTS

| | | | |
|---|---|---|---|
| 995517A | 6/1965 | United Kingdom . | |
| 2220688 | 1/1990 | United Kingdom | E21B 43/04 |

*Primary Examiner*—Ramon S. Britts
*Assistant Examiner*—Frank S. Tsay
*Attorney, Agent, or Firm*—Tracy W. Druce; Dennis T. Griggs

[57] ABSTRACT

The flow apertures of a perforated mandrel are temporarily sealed by plugs which are made of a sacrificial material, for example, zinc, aluminum and magnesium. The sacrificial plugs prevent dirty completion fluid from passing through and in and out of the screen as it is run into the hole, thereby protecting the screen from plugging. During the time the screen mandrel is temporarily sealed by the sacrificial plugs, cleaning fluid is circulated through a work string and is returned through the annulus between the screen and the open well bore for removing filter cake, drilling debris and lost circulation material. After the annulus has been cleaned, the annulus is filled with an acid solution or caustic solution, which dissolves the sacrificial plugs. In an alternative embodiment, each sealing plug has a body portion and a stub portion which project into the mandrel bore. The sealing plug body portion is intersected by a vent pocket which is sealed by the stub portion. The screen mandrel flow apertures are opened by mechanically shearing the stub portion of each sealing plug with a milling tool run on a concentric tubing string.

17 Claims, 4 Drawing Sheets

PLUGGED BASE PIPE FOR SAND CONTROL

FIELD OF THE INVENTION

This invention relates generally to apparatus for completing downhole wells, and in particular to well screens for filtering unconsolidated material out of inflowing well fluid in water, oil, gas and recovery wells.

BACKGROUND OF THE INVENTION

In the course of completing an oil and/or gas well, it is common practice to run a string of protective casing into the well bore and then to run the production tubing inside the casing. At the well site, the casing is perforated across one or more production zones to allow production fluids to enter the casing bore. During production of the formation fluid, formation sand is also swept into the flow path. The formation sand is relatively fine sand that erodes production components in the flow path.

In some completions, however, the well bore is uncased, and an open face is established across the oil or gas bearing zone. Such open bore hole (uncased) arrangements are utilized, for example, in water wells, test wells and horizontal well completions. One or more sand screens are installed in the flow path between the production tubing and the open, uncased well bore face.

After the sand screens are in place, water is pumped through the work string for removing drilling debris, filter cake and lost circulation material from the annulus. Large amounts of filter cake and other debris which is not removed from the bore hole can create potential problems with future water and gas coning effects along the horizontal section. After the annulus along the uncased well bore has been cleaned, a packer is customarily set above the sand screen to seal off the annulus in the zone where production fluids flow into the production tubing. The annulus around the screen may be packed with a relatively coarse sand or gravel which acts as a filter to reduce the amount of fine formation sand reaching the screen.

A common problem experienced during well completion and sand control operations is fluid loss. It is an inherent problem encountered worldwide, due to the high permeability of sandstone reservoirs which allow easy fluid flow into the formation matrix. Many wells which are candidates for sand control produce from marginal reservoirs and have insufficient bottomhole pressures to support a column of fluid in the well bore. Still other wells with high pressure zones require high density completion fluids in order to balance the reservoir pressure during the gravel pack operation. In either case, the positive pressure leads to fluid being lost to the reservoir.

This may cause the following problems: (1) the formation may be damaged by swelling of clay minerals within the formation, (2) formation damage caused by particle invasion into the formation, (3) formation damage caused by dissolution of matrix cementation promoting migration of fines within the formation, (4) flow channel blockage by precipitates caused by ionic interactions between well servicing fluids and formation fluids, (5) interactions between well servicing fluids and formation fluids causing emulsion blocks, water block, or changes in wettability of a producing sand, and (6) flow channel blockage due to viscous fluids creating a barrier in the near well bore region. Moreover, some well completion fluids are expensive, presently costing at over $100 per barrel.

DESCRIPTION OF THE PRIOR ART

During many sand control operations, the standard procedure is to acidize the formation prior to gravel packing, thus increasing the near well bore permeability. Then it is recommended that the acid treatment be followed immediately with a gravel pack treatment until a sandout occurs. After gravel packing, the well bore is frequently in a lost circulation condition. This requires either keeping the hole full, resulting in loss of large volumes of completion fluid to the formation, or unknowingly spotting an inappropriate fluid loss pill. Both options can result in formation damage and excessive completion costs.

A critical operation during the completion phase is pulling the work string and running the production tubing after the lost circulation material has been removed from the annulus along the face of an uncased well bore section. As a result of removing the lost circulation material, great amounts of completion fluid may be lost into the formation. These fluids will cause formation damage, such as the swelling of clays which inhibit the formation from producing oil or gas, known as permeability damage of the producing formation.

Due to the heavy weight load imposed by some bottom hole completion assemblies, the screen may become plugged as it passes over the low side cuttings and rubs against the lost circulation type filter cake. If the screen section is run several thousand feet along a horizontal open hole section or if rotation is required to advance the screen, it is likely that the screen will become plugged as it contacts the exposed formation, the lost circulation plugging materials and drilling debris. The plugging materials and debris will be pressed into the flow apertures of the screen and may plug the base pipe perforations.

One method which has been utilized to reduce the loss of circulation fluid is to install a large O.D. washpipe across the screen, which will decrease the return flow along the inner screen/washpipe annulus. However, if the completion fluids are dirty, the entire screen section may be plugged from the inside out during the running procedure. Moreover, the use of large O.D. washpipe increases the weight of the bottom hole assembly, and reduces the flexibility and the ability of the screen assembly to pass the bend section. Additionally, an increase in the weight of the bottom hole assembly imposed by the heavy, large O.D. washpipe makes it more difficult for the vertical section of the pipe to push the screen assembly through the bend and the horizontal section. Consequently, more powerful running equipment is needed at the wellhead. The foregoing are major problems which are commonly encountered in the completion of horizontal wells.

OBJECTS OF THE INVENTION

A general object of the present invention is to provide an improved sand screen assembly which will temporarily prevent the circulation of dirty completion fluid through the screen as it is run into the well, thereby protecting the screen from plugging.

Another object of the present invention is to reduce the loss of completion fluid into the formation during the pulling of the work string and the running of the production tubing.

Yet another object of the present invention is to maintain good flexibility in the sand screen assembly as it is run into the well.

A related object of the present invention is to eliminate the need to run large O.D. washpipe across the screen for the purpose of decreasing the circulation area in the screen I.D./washpipe O.D. annulus.

Still another object of the present invention is to prevent the plugging and contamination of the sand screen assembly caused by the circulation of dirty completion fluids from the inside of the screen assembly through the screen sections as the screen is being run into the well.

Another object of the present invention is to provide an improved well screen assembly for onetime zone production control.

Another object of the present invention is to provide an improved sand screen assembly and method for cleaning the annulus between the sand screen assembly in an open face well bore which will allow turbulent circulation across the open hole section without plugging the perforated screen mandrel.

A related object of the present invention is to reduce the overall weight of the bottom hole sand screen assembly, thereby increasing the distance the bottom hole assembly can be run through a horizontal well bore.

SUMMARY OF THE INVENTION

The foregoing objects are achieved according to one aspect of the present invention by a well screen assembly in which the flow apertures of a perforated mandrel are sealed by plugs which are made of a sacrificial material, for example, zinc, aluminum and magnesium. The sacrificial plugs temporarily prevent dirty completion fluid from passing through (in and out of) the screen as it is run into the hole, thereby protecting the screen from plugging. After the downhole screen assembly reaches its final position, cleaning fluid is circulated through the end of work string and is returned through the annulus between the screen and the open well bore for removing filter cake, drilling debris and lost circulation material. After the annulus has been cleaned, the base pipe mandrel is filled with an acid solution, for example, HCL or HF, or by a caustic solution such as sodium hydroxide (NaOH) or potassium hydroxide (KOH), to dissolve the plugs and to clean the surface of the screen. The specific acid or caustic solution to be used will be determined in part by the characteristics of the producing formation. After the plugs have dissolved, well completion operations such as gravel packing can be performed, as desired.

According to another aspect of the invention, the fluid-porous, particulate-restricting member of the sand screen is enclosed within a protective shell which is mounted on the screen mandrel. In this embodiment, the inner base pipe flow apertures of the screen mandrel remain open, and outer bypass apertures are formed through the protective shell. Each outer bypass aperture in the protective shell is sealed by a sacrificial plug. The sacrificial plugs in the protective shell are removed by dissolving them with an acid solution.

According to yet another aspect of the present invention, each sealing plug has a body portion and a stub portion which projects into the mandrel bore. The sealing plug body portion is intersected by a vent pocket which is sealed by the stub portion. The flow apertures in the screen mandrel are opened by mechanically shearing the stub portion from the body portion of each sealing plug.

Operational features and advantages of the present invention will be understood by those skilled in the art upon reading the detailed description which follows with reference to the attached drawings.

DETAILED DESCRIPTION OF THE PREFERRED EMBODIMENTS

Figure 1:
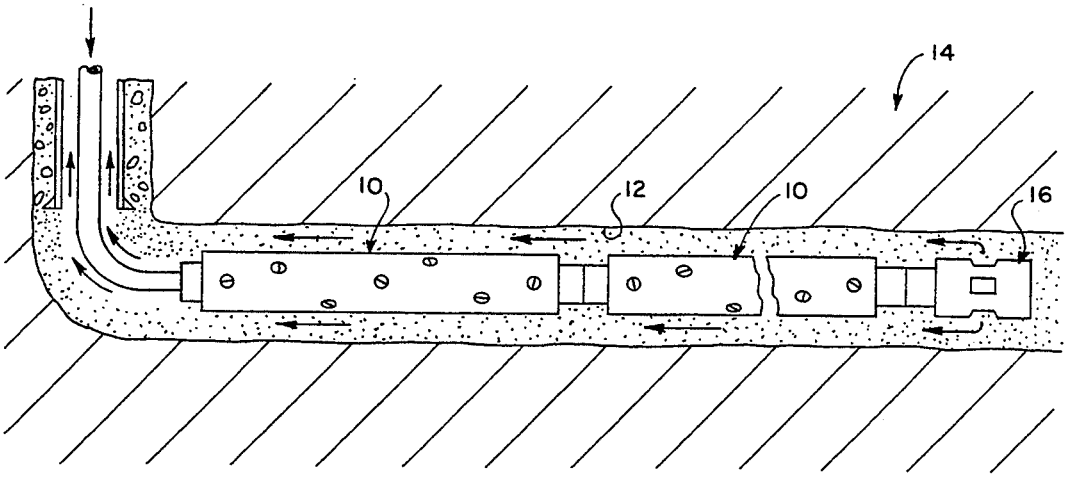
FIG. 1 is a simplified, sectional view which illustrates a horizontal well completion in an uncased well bore.

In the description which follows, like parts are indicated throughout the specification and drawings with the same reference numerals, respectively. The drawings are not necessarily to scale and the proportions of certain parts have been exaggerated to better illustrate details of the invention.

Referring now to FIG. 1, a sand screen 10 is shown installed in an uncased horizontal bore 12 which penetrates horizontally through an unconsolidated formation 14. Multiple screen sections 10 are assembled together, with the screen assembly being terminated by a circulation sub 16. This particular screen design may also be used in vertical wells.

Figure 2:
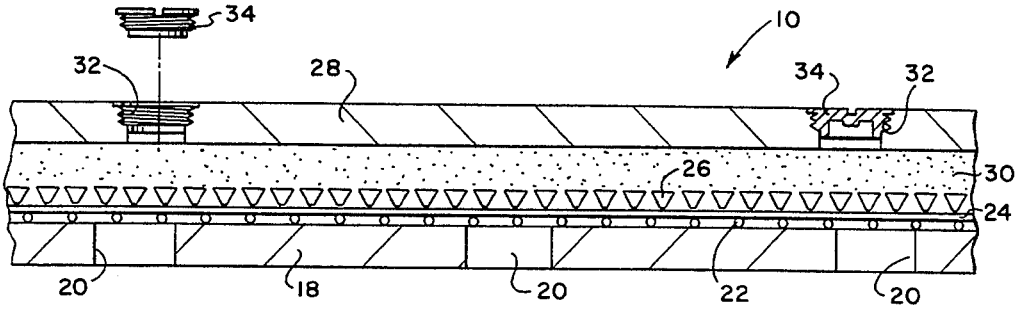
FIG. 2 is a sectional view, partially broken away, of a portion of the well screen shown in FIG. 1.
Figure 3:
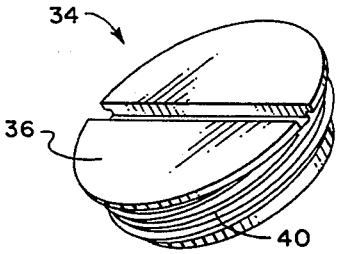
FIG. 3 is a top perspective view of a sacrificial sealing plug.
Figure 4:
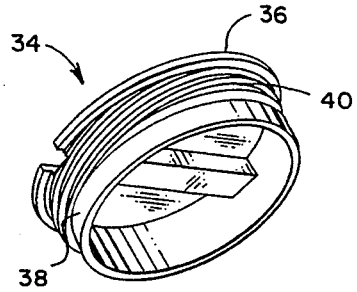
FIG. 4 is a bottom perspective view of the sacrificial sealing plug shown in FIG. 3.

Referring now to FIG. 2, FIG. 3 and FIG. 4, the screen section 10 includes a tubular mandrel 18 which is perforated by radial flow apertures 20. The screen 10 consists of a small diameter inner screen wire 22 wrapped about the base pipe mandrel 18, and circumferentially spaced, longitudinally extending rib wires 24 thereby defining longitudinally spaced inner screen apertures for conducting formation fluids through the inner screen, and a large screen wire 26 having a keystone cross section wrapped externally about the rib wires in a longitudinally spaced pattern, thereby defining relatively larger longitudinally spaced screen apertures for conducting formation fluids.

The wire wrapped screen members are enclosed within a protective, cylindrical shell 28 which is concentrically disposed about the perforated mandrel 18. The protective shell 28 is secured to the perforated mandrel 18 by a weld union W. The annulus between the protective shell 28 and the wire wrapped screen is filled with a prepacked gravel deposit 30. The prepacked gravel deposit 30 and the surrounding protective shell 28 must be capable of withstanding rough, run-in handling as well as extreme downhole well production conditions, such as an operating temperature in the range of from about 50 degrees C. to about 300 degrees C., a formation fluid pH of from about 2 to about 12, high formation pressure up to about 2,000 psi, and contact with corrosive formation fluids containing sulfurous compounds such as hydrogen sulfide or sulfur dioxide.

The prepacked gravel deposit 30 includes gravel particles which are generally spherical in shape to provide high permeability. The gravel particles can be coarse sand, solid polymeric granules, composite particles having a metal core surrounded by a corrosion resistant metal coating, and the like, which are sized appropriately to permit passage of formation fluid through the consolidated gravel particles while substantially preventing flow of sand and other consolidated formation materials.

The sand fines which may be produced following completion may have a fairly small grain diameter, for example, 20–40 mesh sand. Accordingly, the spacing dimension between adjacent turns of the wire wrapped screen 26 is selected to exclude sand fines which exceed 20 mesh.

The primary application of the screen 10 is the open hole, unconsolidated formation 14 where no gravel pack will be pumped. The formation 14 is simply allowed to slough in and gravel pack itself. This is most desirable in situations where it is questionable whether the unconsolidated formation will allow a liner to be successfully set and when intermixing of the formation sand and gravel pack is probable if a gravel pack is attempted. This condition is most prevalent in highly deviated and horizontal well bores.

The purpose of the shell 10 is to protect the wire wrapped screen and prepacked gravel 30 from exposure to well debris and from damage caused by rough handling. The protective shell 28 is intersected by radial flow apertures 32 which permit entry of formation fluid into the screen. However, the flow apertures 32 are subject to being plugged by lost circulation filter cake, drilling debris and low side formation materials as the screen is run in place.

The radial flow apertures 32 are temporarily sealed by sacrificial plugs 34. In the preferred embodiment, each plug 34 is fabricated from a sacrificial metal such as zinc, aluminum and magnesium. As used herein, the term "sacrificial" refers to the property of a material as being subject to being dissolved when contacted by a high pH acid or a low pH base solution. It is desirable that the metal selected be characterized by a relatively faster rate of etching or dissolution when contacted by an acid or base solution, as compared to the rate that the base pipe mandrel 18 is affected.

In the preferred embodiment shown in FIG. 3 and FIG. 4, the plug 34 has a disk body portion 36 and a cylindrical sidewall 38 on which threads 40 are formed. During initial assembly, each flow aperture 32 is sealed by threaded engagement of the plugs 34. The thickness of the disk portion 36 is selected so that it will be completely dissolved within a predetermined period of exposure to a corrosive, acid solution or base solution, for example, four hours. As the plugs 34 dissolve, the flow apertures 32 are opened up to permit the flow of formation fluid into the screen.

Referring now to FIG. 6, FIG. 7, FIG. 8 and FIG. 9, an alternative sand screen assembly 42 is illustrated. According to this arrangement, each sand screen section 42 includes the perforated screen mandrel 18 having radial flow apertures 20 of a unitary, porous sleeve of sintered powdered metal. The sintered powdered metal preferably is a corrosion resistant metal such as stainless steel or nickel or nickel chromium alloys such as are sold under the trademarks MONEL and INCONEL. In this embodiment, the sintered metal screen body 44 provides a matrix having a pore size of about 100–150 microns, corresponding to 40–60 mesh. Preferably, the sintered metal sleeve 44 is constructed as disclosed in U.S. Pat. No. 5,088,554 entitled "Sintered Metal Sand Screen", assigned to Otis Engineering Corporation of Carrollton, Tex., and which is incorporated herein by reference for all purposes.

The sintered metal sand screen body 44 is a fluid-porous, particulate-restricting member in the form of a tubular sintered metal sleeve having a length in the range of from about 36 inches to about 42 inches. The tubular sleeve 44 is preferably composed of slivers of metal, for example, stainless steel having a length in the range of from about 50 microns to about 1,400 microns. The stainless steel slivers are compressed and then sintered in an oven to yield a porous body having an average pore size in the range of from about 0.001 inch to about 0.006 inch.

The tubular mandrel 18 is perforated by radial flow passages 20 which follow spiral paths along the length of the mandrel 18. The radial bore flow passages 20 permit fluid flow through the mandrel to the extent permitted by the external sintered metal sand screen sleeves 44. The radial bore apertures 20 may be arranged in any desirable pattern and may vary in number, for example, 30 holes per linear foot or 54 holes per linear foot, in accordance with the area needed to accommodate the expected formation fluid flow through the production tubing 46. Adjacent screen sections are coupled together on the mandrel 18 by an annular spacing ring 48 and by resilient, annular seal rings 50, 52. The annular spacer ring 48 is preferably constructed of a corrosion resistant, stainless steel alloy, and the annular seal rings 50, 52 are preferably constructed of a resilient, elastomeric material having properties compatible with the expected downhole pressure, temperature and corrosive environment conditions.

According to this embodiment, the flow apertures 20 are temporarily sealed by shearable plugs 54. Each plug has an elongated, threaded body portion 56, and the flow apertures 20 have mating threads for engaging the threaded body portion. The threaded body portion is intersected by a relief pocket 58 which is sealed by a stub portion 60. The relief pocket extends partially into the stub portion 60.

Figure 7:
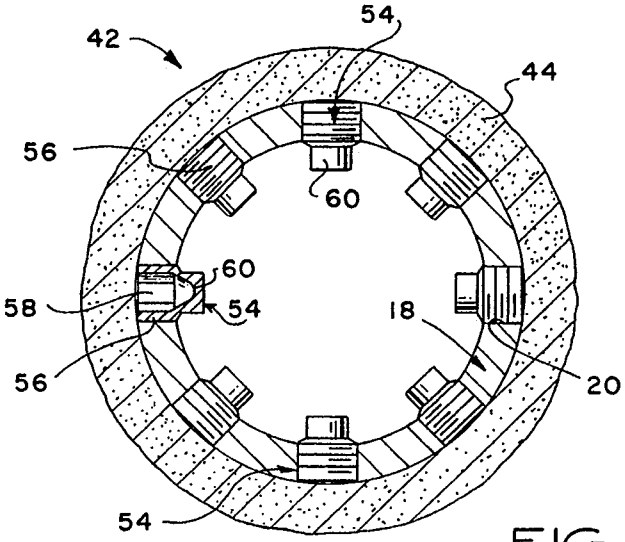
FIG. 7 is a sectional view taken along the line 7—7 of FIG. 6.

Referring to FIG. 7, the threaded body portion 56 of each sealing plug 54 engages the mandrel sidewall 18 with the stub portion 60 projecting radially into the bore of the screen mandrel 18. After the annulus between the screen and the uncased well bore has been cleared, the radial flow apertures are opened by mechanically shearing the projecting stub portions. This is performed with a milling tool which is run on a concentric tubing string. Alternatively, the plugs are removed by flooding the bore of the screen mandrel 18 with an acid solution, so that the plugs are dissolved. In that arrangement, the plugs are constructed of a metal which dissolves readily when contacted by an acid solution, for example, zinc, aluminum and magnesium. Zinc is the preferred metal since it exhibits the fastest dissolving rate.

Figure 10:
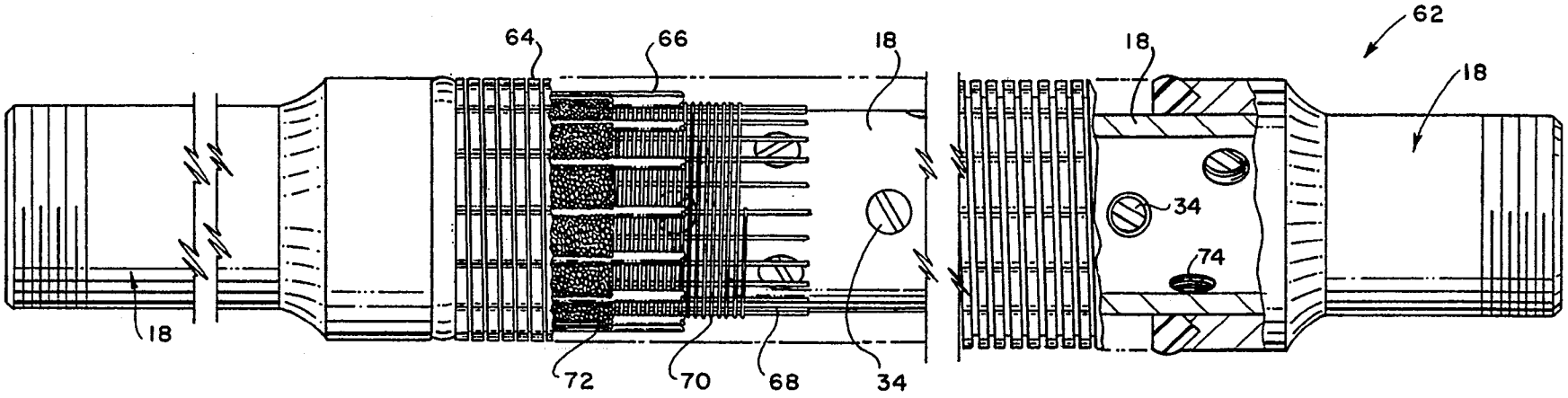
FIG. 10 is an elevational view, partially broken away and partially in section, showing a wire wrapped sand screen which is assembled on a perforated mandrel which has been sealed according to the teachings of the present invention; and, FIG. 11 is a sectional view, partially broken away, showing a portion of the wire wrapped sand screen of FIG. 10.
Figure 11:
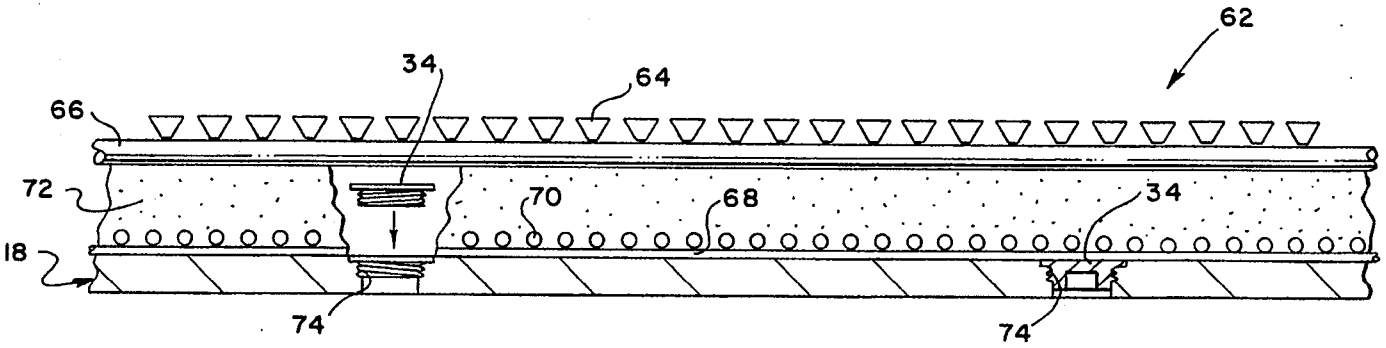

Referring now to FIGS. 10 and 11, an alternative sand screen embodiment 62 is illustrated. In this embodiment, an external screen wire 64 is wrapped about longitudinally extending, circumferentially spaced rib wires 66. The ribs 66 are radially spaced with respect to an inner screen formed by longitudinal rib wires 68 and a small diameter wire wrap 70. In the annulus between the inner screen and the outer screen is a deposit of prepacked gravel 72. The mandrel 18 is intersected by radial flow apertures 74. In this arrangement, the flow apertures 74 are temporarily sealed by the sacrificial plugs 34. After the annulus has been cleared, the bore of the screen mandrel 18 is flooded with an acid solution, which causes the plugs to dissolve.

It will be appreciated that the use of the temporary plugs will enhance running procedures and bore hole cleaning techniques. The plugs temporarily eliminate any dirty completion fluid from passing through the primary screen sections as it is run into the hole. The elimination of dirty completion fluids passing in and out of the screen as it is run into the well protects the screen from plugging.

The use of the sacrificial plugs also eliminates the need to run large O.D. washpipe across the screen in order to decrease the circulation area in the screen I.D./washpipe O.D. annulus. This enhances the circulation cleaning effect between the open hole and the screen O.D. while filter cake and lost circulation material is being removed. Large amounts of filter cake and drilling debris which is not removed from the bore hole may reduce production.

Because the flow apertures of the screen mandrel are temporarily sealed by the plugs, a substantially smaller diameter washpipe can be used, and in some cases no washpipe is required at all. In the arrangement shown in FIG. 1, water is pumped down the work string through the well screens for circulating through the well bore annulus, thus removing the filter cake residue and drilling debris. By using a smaller washpipe or no washpipe at all, the tubing string becomes more flexible and will allow the screen assembly to pass the bend section more easily as compared with a larger and heavier inner washpipe configuration which tends to be more rigid. The reduction in weight of the sand screen assembly also permits the weight of the pipe in the vertical section to push the sand screen assembly through the bend and the horizontal section.

Another advantage of the temporary plugs is the prevention of loss of large volumes of completion fluid into the formation. The temporary plugs serve as a temporary lost circulation plugging system and reduces the amount of completion fluid loss. Additionally, by using the temporary plugs, the screen mandrel bore and work screen can be filled with clean completion fluid as the screen assembly is run into the well bore. This prevents plugging and clogging of the screen from the inside out during the running procedure.

Another advantage is that for an initial, one-time zonal production control, selected areas along the horizontal section can be isolated and produced by selectively dissolving the plugs in each screen section.

Figure 5:
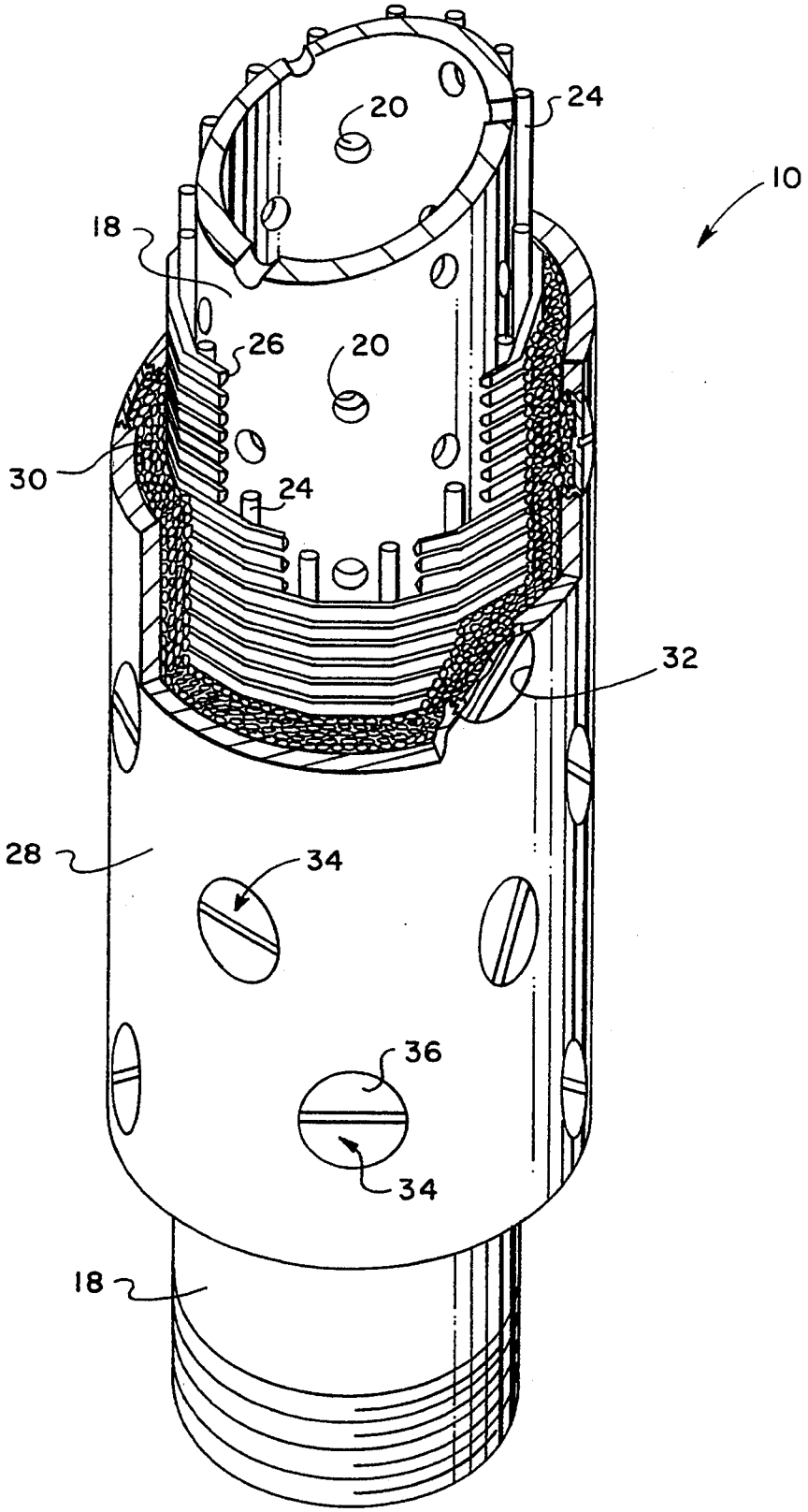
FIG. 5 is a perspective view, partially broken away, of the sand screen shown in FIG. 1.
Figure 6:
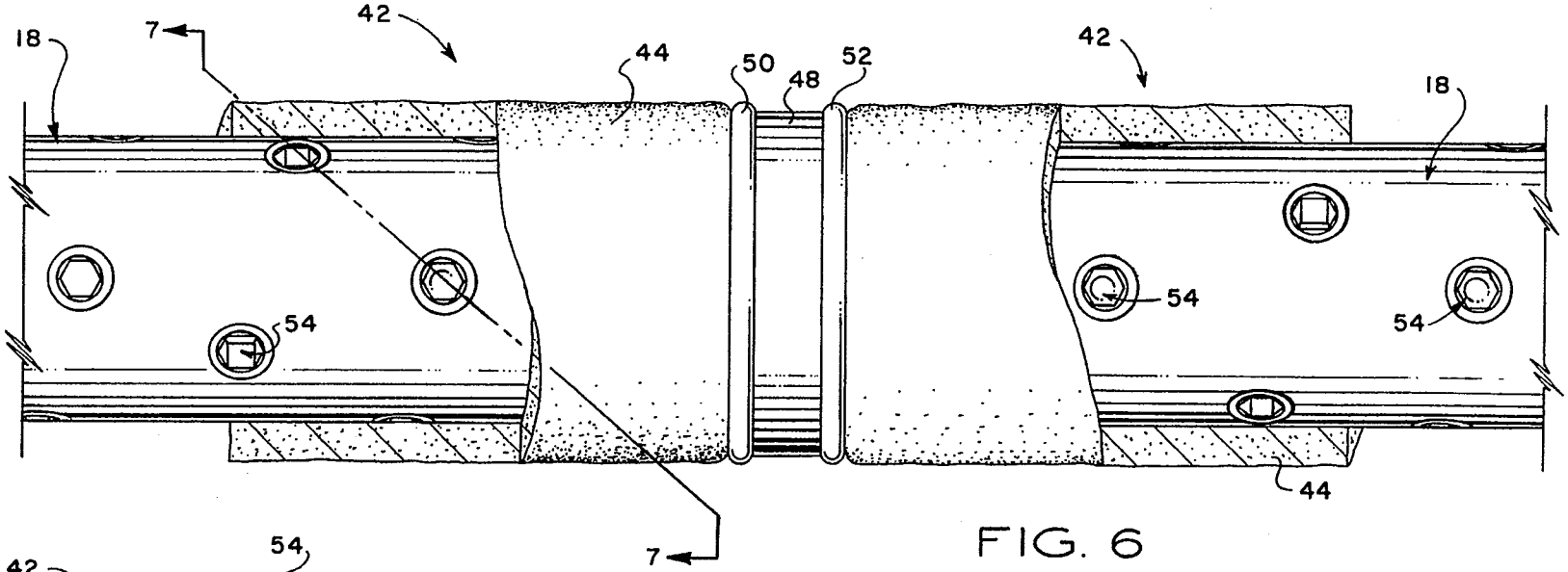
FIG. 6 is a front elevational view, partially broken away and partially in section, showing a sintered metal sand screen embodiment of the present invention.
Figure 9:
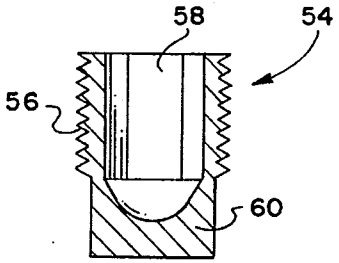
FIG. 9 is a sectional view thereof taken along the line 9—9 of FIG. 8.
Figure 8:
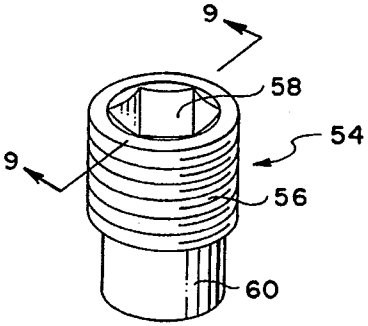
FIG. 8 is a perspective view of a sealing plug having a shearable body portion.

Because of the extremely heavy weights of some of the large bottom hole completion screen assemblies, the screen may become plugged as it passes over the low side cuttings and drags across the lost circulation filter cake. In some installations, the screens must travel 2,000 and 3,000 feet along a horizontal open hole section. If rotation is required, it is likely that the screen will be plugged as it is pushed across the exposed formation and contacts the lost circulation plugging materials and/or drilling debris. The protective shell embodiment as shown in FIG. 1 and FIG. 5 prevents this from occurring.

The use of the temporary plugs also permits the annulus to be cleaned using turbulent circulation techniques without risk of plugging the screen. Moreover, the temporary plugs serve as a mechanical fluid loss barrier as the work string and production tubing are moved in and out of the hole.

Various modifications of the disclosed exemplary embodiments as well as alternative well completion applications of the invention will be suggested to persons skilled in the art by the foregoing specification and illustrations. It is therefore contemplated that the appended claims will cover any such modifications or embodiments that fall within the true scope of the invention.

What is claimed is:

1. A well screen for separating particulated material from formation fluid comprising, in combination:

an elongated, tubular mandrel having a longitudinal bore defining a production flow passage, said mandrel being radially intersected by longitudinally spaced flow apertures;

a fluid-porous, particulate-restricting member mounted on said mandrel and covering said flow apertures;

a protective shell mounted on said mandrel and having a tubular sidewall disposed about said fluid-porous, particulate-restricting member, said shell sidewall being radially intersected by a flow aperture; and, a sacrificial plug secured to said shell sidewall and sealing said flow aperture.

2. A well screen as defined in claim 1, wherein said plug comprises zinc.

3. A well screen as defined in claim 1, wherein said plug comprises aluminum.

4. A well screen as defined in claim 1, wherein said plug comprises magnesium.

5. A well screen as defined in claim 1, wherein said flow aperture comprises a threaded bore, and said plug comprises a disk having a threaded body portion disposed in threaded engagement with said threaded bore.

6. A well screen as defined in claim 1, wherein said fluid-porous, particulate-restricting member comprises a permeable sleeve of sintered powdered metal.

7. A well screen as defined in claim 1, wherein said fluid-porous, particulate-restricting member comprises circumferentially spaced, longitudinally extending rib wires and a screen wire wrapped externally about said rib wires in a longitudinally spaced pattern, thereby defining longitudinally spaced screen apertures for conducting formation fluids through said outer screen.

8. A well screen for placement within a well bore comprising, in combination:

an elongated mandrel having a tubular sidewall and longitudinally spaced flow apertures formed radially therethrough;

a fluid-porous, particulate-restricting member mounted on said mandrel; and, a sealing plug disposed in each flow aperture, respectively, each sealing plug having a body portion which dissolves in response to contact by an acid solution or caustic solution, and each sealing plug being capable of sealing operation without rupture with respect to a column of completion fluid above the screen during a well completion procedure.

9. A well screen as defined in claim 8, wherein said body portion comprises zinc.

10. A well screen as defined in claim 8, wherein said body portion comprises aluminum.

11. A well screen as defined in claim 8, wherein said body portion comprises magnesium.

12. A sand screen for placement within a well bore comprising, in combination:

an elongated mandrel having a tubular sidewall enclosing a production bore and longitudinally spaced flow apertures formed radially therethrough;

a fluid-porous, particulate-restricting member mounted on said mandrel; and, a sealing plug disposed in each flow aperture, respectively, each sealing plug having a body portion engaging said mandrel sidewall and having a stub portion projecting into said mandrel bore, said body portion being intersected by a vent pocket, and said vent pocket being sealed by said stub portion.

13. A sand screen as defined in claim 12, wherein said sealing plug comprises a shearable material.

14. A sand screen as defined in claim 13, wherein the body portion of said sealing plug comprises a metal selected from the group consisting of zinc, aluminum and magnesium.

15. In the completion of a well wherein a well screen having a perforated mandrel is run through a well bore, the improvement comprising the steps:

sealing each screen mandrel perforation with a sacrificial plug;

pumping cleaning fluid through the annulus between the screen and the well bore for removing debris from the annulus; and, after the annulus has been cleaned, removing the plugs.

16. An improved well completion method as defined in claim 15, in which the plugs are made of a sacrificial material, and the removing step is performed by conducting an acid solution or caustic solution in contact with the plugs.

17. An improved well completion method as defined in claim 15, wherein each sealing plug has a body portion engaging the screen mandrel and having a stub portion projecting into the mandrel bore, and the sealing plug body portion being intersected by a vent pocket which is sealed by the stub portion, wherein each perforation is opened by mechanically shearing the stub portion from the body portion of each sealing plug.

* * * * *